United States Patent [19]

Okazaki et al.

[11] Patent Number: 4,829,940

[45] Date of Patent: May 16, 1989

[54] PISTON FOR TWO-CYCLE ENGINES

[75] Inventors: Masaki Okazaki; Kazutoshi Sato; Hiroaki Fujimoto, all of Hamamatsu, Japan

[73] Assignee: Sanshin Kogyo Kabushiki Kaisha, Hamamatsu, Japan

[21] Appl. No.: 150,549

[22] Filed: Feb. 1, 1988

[30] Foreign Application Priority Data

Feb. 9, 1987 [JP] Japan ..... 62-27778

[51] Int. Cl.[4] ..... F01P 1/04

[52] U.S. Cl. ..... 123/41.39; 123/73 AA

[58] Field of Search ..... 123/41.35, 41.39, 65 P, 123/73 AA, 73 PP, 73 SC, 193 P

[56] References Cited

U.S. PATENT DOCUMENTS 1,371,905 3/1921 Kloneck ..... 123/73 AA
1,844,109 2/1932 Speer ..... 123/41.39
2,224,229 12/1940 Miller ..... 123/41.39
2,744,508 5/1956 Elsbett ..... 123/41.39
2,979,045 4/1961 Busch ..... 123/73 AA

FOREIGN PATENT DOCUMENTS 0768122 11/1955 Fed. Rep. of Germany ... 123/41.39
0035014 2/1987 Japan ..... 123/41.39

*Primary Examiner*—Willis R. Wolfe
*Attorney, Agent, or Firm*—Ernest A. Beutler

[57] ABSTRACT

Several embodiments of cooling arrangements for the pistons of an internal combustion engine operating on a two-cycle, crankcase compression principle. The cooling arrangement comprises a passage that is formed in the piston and which communicates the ports of the engine with each other when the piston is in confronting relationship with them so as to effect a cooling air flow across the piston through the communicating passage.

20 Claims, 2 Drawing Sheets

PISTON FOR TWO-CYCLE ENGINES

BACKGROUND OF THE INVENTION

This invention relates to a piston for two-cycle engines and more particularly to an improved arrangement for cooling the pistons of a two-cycle internal combustion engine.

As is well known, the problem of heat dissipation is a particularly important one in connection with internal combustion engines. The piston and particularly its head is one of the more highly heated components of the engine. It is essential that the heat that is transmitted to the head of the piston can be effectively dissipated so as to avoid overheating of the piston. This problem is particularly acute since the piston is not in any significant direct contact with the cylinder bore which, itself, normally is provided with its own cooling system. As a result, heat must be transferred from the piston to the cylinder bore for dissipation through the piston rings. Also, the lubricating system of a four-cycle engine may be employed for cooling the piston during engine operation.

It should be obvious that unless the piston is adequately cooled, in addition to the possibility of piston burning, there becomes the likelihood that the highly heated piston can deform and bind in the cylinder bore. The problems of heat dissipation in two-cycle internal combustion engines are particularly acute. Because the intake and exhaust ports are normally formed by openings in the cylinder wall, the area of contact between the piston rings and cylinder wall are greatly reduced. Also, with a two-cycle engine, the exhaust gases in the exhaust port also contact the piston during times when the exhaust port is closed and thus can further add to the head loading on the piston.

Because of the heat loading on pistons in two-cycle engines and the particular problems attendant therewith, the configuration and the shape of the piston in these engines is even more critical than with a four-cycle engine. In addition to the heat dissipation problems aforenoted, there is also the question of insuring good sealing by the piston rings under varying heat conditions and also the concern that the piston rings may become lodged with carbon due to high heat and improper heat dissipation.

It is, therefore, a principal object of this invention to provide an improved arrangement for cooling the piston of an engine.

It is a further object of this invention to provide an arrangement for cooling the piston of a two-cycle internal combustion engine.

It is a still further object of this invention to provide an arrangement for cooling a two-cycle piston by providing a flow of air across the piston even at the time when the ports of the engine are closed.

SUMMARY OF THE INVENTION

This invention is adapted to be embodied in a two-cycle internal combustion that comprises a cylinder which defines a cylinder bore. A piston reciprocates in the cylinder bore and has a head portion that faces a combustion chamber. A pair of circumferentially spaced ports extend through the cylinder for communication with the cylinder bore upon reciprocation of the piston in the cylinder bore. In accordance with the invention, passage means are formed in the piston for permitting flow between the ports when the piston is in confronting relationship with the ports for effecting a cooling flow across the piston to dissipate heat therefrom.

DETAILED DESCRIPTION OF THE PREFERRED EMBODIMENTS

Figure 1:
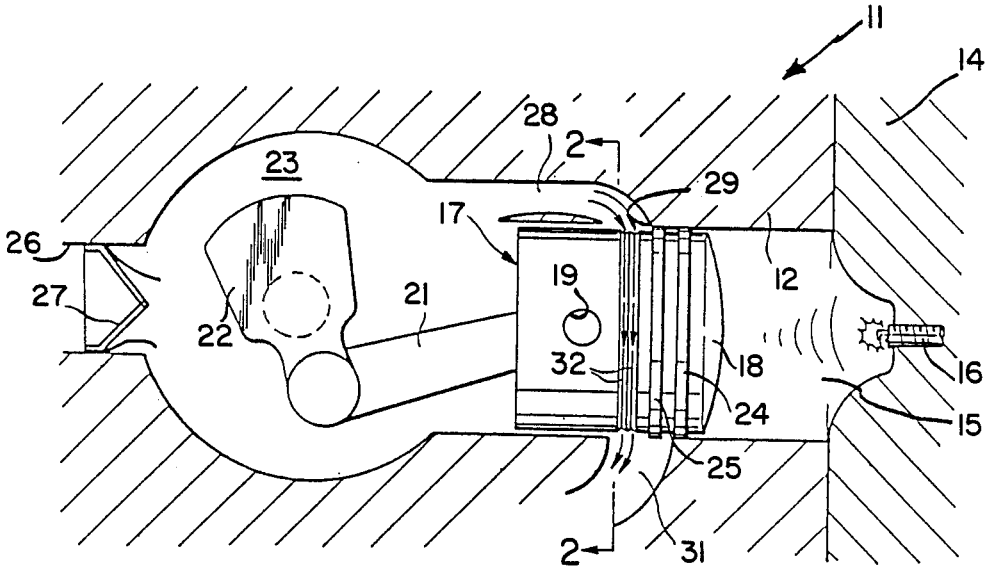
FIG. 1 is a cross-sectional view taken through the cylinder bore of a two-cycle internal combustion engine constructed in accordance with an embodiment of the invention.
Figure 2:
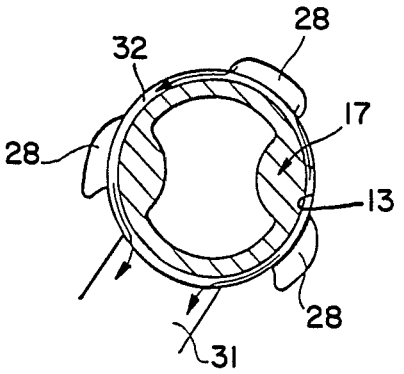
FIG. 2 is a cross-sectional view taken along the line 2—2 of FIG. 1.

Referring first to FIGS. 1 and 2, a two-cycle internal combustion engine constructed in accordance with an embodiment of the invention is identified generally by the reference numeral 11. The engine 11 includes a cylinder block 12 in which one or more cylinder bores 13 are formed. A cylinder head 14 is affixed in a known manner to the cylinder block 12 and defines a combustion chamber 15 in combination with each of the cylinder bores 13. A spark plug 16 is supported within the cylinder head 14 for firing the charge in the combustion chamber 15 at the appropriate time interval.

It should be noted that the engine including the cylinder block 12 and cylinder head 14 may be provided with a cooling system which can be of either the air of liquid type. This portion of the cooling system for the engine forms no part of the invention and, therefore, has not been illustrated nor is description believed to be necessary.

A piston 17, constructed in accordance with an embodiment of the invention, is supported for reciprocation within the cylinder bore 13. The piston 17 has a head portion 18 that cooperates with the cylinder bore 13 and cylinder head 14 to complete the definition of the combustion chamber 15. The piston 17 is connected by means of a piston pin 19 to one end of a connecting rod 21. The opposite or big end of the connecting rod 21 is journaled on a throw of a crankshaft 22. The crankshaft 22 is journaled for rotation within a crankcase 23 that is formed beneath the cylinder bore 13 in a known manner. Specifically, the crankcase 23 may be formed by the cylinder block 12 and by a crankcase housing that is affixed in a known manner to the cylinder block 14.

The piston 17 is provided with a pair of circumferentially extending grooves in which piston rings 24 and 25 are received for effecting sealing with the cylinder bore 13.

As has been noted, the engine 11 is of the two-cycle type and in accordance with normal crankcase compression operation of such engines, an intake manifold 26 enters into the crankcase chamber 23 for delivering at least an air charge thereto. A reed-type check valve 27 is provided in the intake manifold 26 so as to prevent the reverse flow of charge from the crankcase chamber 23 back into the intake manifold 26 when the piston 17 is moving downwardly to compress the charge in the crankcase chamber 23. The charge delivered to the crankcase chamber 23 through the intake manifold 26 may be either a fuel/air charge or a pure air charge with the fuel being delivered into the crankcase chamber 23 by means of an injection nozzle (not shown). Like the basic construction of the engine, the means by which a charge is delivered to the crankcase chamber 23 is not necessary to understand the construction and operation of the invention.

The charge which has been admitted to the crankcase 23 during the upward movement of the piston 17 in the cylinder bore 13 and which is then compressed upon the downward movement of the piston 17 is transferred to the combustion chamber 15 through a plurality of circumferentially spaced scavenge or transfer passages 28. The scavenge passages 28 extend from an opening in the crankcase chamber 23 to ports 29 formed in the cylinder 12 and which communicate with the cylinder bore 13 when the piston 17 approaches its bottom dead center position.

The intake charge which has thus been delivered to the combustion chamber 15 through the scavenge passages 28 and scavenge ports 29 is fired by the spark plug 16 when the piston 17 approaches its top dead center position. The expanding combustion gases are then exhausted through an exhaust port 31 that extends through the cylinder block 12 from the cylinder bore 13. The exhaust port 31 is opened when the piston 17 approaches its bottom dead center position and before the scavenge ports 29 are opened, as is known in two-cycle engine practice. It should be noted from FIG. 2 that the scavenge ports 28 are disposed on one side of the cylinder bore 13 with the exhaust port 31 being formed between a pair of adjacent scavenge passages 28. This type of porting system is common with the Schnurel-type scavenging system.

As has been noted, the problems of heat dissipation from the piston are significant and particularly acute in connection with two-cycle internal combustion engines. In accordance with the invention, an arrangement is provided for permitting flow from certain of the ports 28 and 31 to each other even when the piston 17 is in confronting relationship therewith so as to provide a cooling flow across the piston 17 and to achieve heat dissipation.

In accordance with this embodiment of the invention, the piston 17 is provided with a plurality of such flow extending passages in the form of circumferentially extending grooves or recesses 32 that extend completely around the circumference of the piston 17. In this embodiment, the grooves 32 are positioned between the lowermost piston ring 25 and the piston pin 19 and communicate all of the ports 28 and 31 with each other. As a result, even when the piston 17 is in confronting relationship with the ports, a flow of cool air will occur from the crankcase chamber 23 to the exhaust port 31 through the transfer passages 28 and grooves 32. Thus, heat will be rapidly dissipated from the pistons 17 and the heat loading on the piston 17 will be substantially reduced from conventional engines.

It should be noted that the depth of the grooves is such that they will permit a fair air flow transfer and thus they serve as more than oil retaining grooves. In fact, it is desirable to avoid oil accumulating in the grooves 32 to any significant extent because accumulated oil would reduce the air flow. However, the flow area should be such that significant compression and intake charge is not lost.

Figure 3:
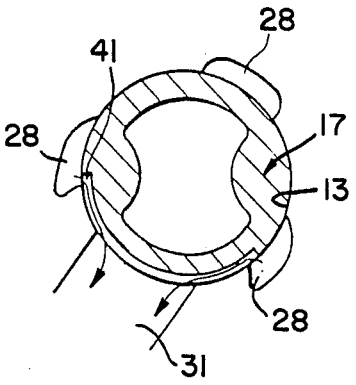
FIG. 3 is a cross-sectional view, in part similar to FIG. 2, showing another embodiment of the invention.

FIG. 3 shows another embodiment of the invention which is generally similar to the embodiments of FIGS. 1 and 2 and, for that reason, components of this embodiment which are the same as the previously described embodiment are indicated by the same reference numerals. Also, because of the similarity, only a view corresponding to the view of FIG. 2 is believed to be necessary to understand the construction of this embodiment.

In this embodiment, there are provide one or more circumferential flow grooves 41 that extend between the scavenge ports 28 adjacent the exhaust port 31 and the exhaust port 31. The grooves 41 do not extend completely circumferentially around the piston 17 but only between the exhaust port and the adjacent scavenge ports 28. There may be one or more such grooves 41 and, like the embodiment of FIGS. 1 and 2, the grooves in this embodiment may be positioned between the lowermost piston ring 25 and the piston pin 19.

Figure 4:
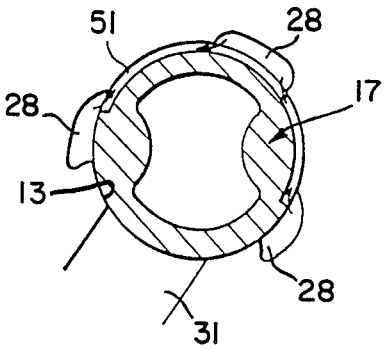
FIG. 4 is a cross-sectional view, in part similar to FIGS. 2 and 3, showing yet another embodiment of the invention.

FIG. 4 shows another embodiment of the invention which is generally similar to the aforedescribed embodiments. In this embodiment, however, the piston 17 is provided with partial circumferentially extending grooves 51 that do not communicate with the exhaust port 31 but only communicate the scavenge ports 28 with each other. There will be some pressure difference between these scavenge passages 28 and this pressure difference will permit some flow through the grooves 51 so as to achieve cooling of the piston 17. In this embodiment, the heat transferred is returned back to the crankcase chamber 23 and then will be dissipated during the remainder of the engine operation. Like the embodiment of FIGS. 1 and 3, the grooves 51 in this embodiment may be formed between the lowermost piston ring 25 and the piston pin 19.

Figure 5:
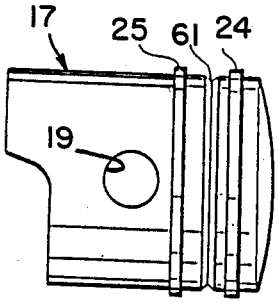
FIG. 5 is a side elevational view of a piston constructed in accordance with another embodiment of the invention.

FIG. 5 shows yet another embodiment of the invention. In this embodiment, unlike the previously described embodiments, cooling grooves 61 are formed in the piston 17 between the uppermost piston ring 24 and the lowermost piston ring 25. Like the previously described embodiment, the grooves 61 may extend around the completely circumference of the piston 17 so as to communicate all of the ports 28 and 31 with each other or only partially as in FIGS. 3 and 4.

Figure 6:
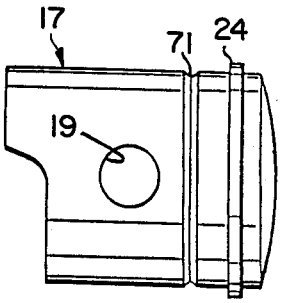
FIG. 6 is a side elevational view, in part similar to FIG. 5, showing yet another embodiment of the invention.

FIG. 6 shows another embodiment of the invention wherein one or more circumferentially extending cooling grooves 71 are provided in the piston 17 below the uppermost piston ring 24. The grooves 71 provide a labyrinth-type seal upon reciprocation of the piston which will act to prevent blow-by and, hence, it has been found that it is possible to eliminate one of the piston rings by the use of such grooves.

It should be readily apparent from the foregoing description that a number of embodiments of the invention have been illustrated and described and each of which provides effective piston cooling by communicating some of the ports of a two-cycle engine with each other even when the piston is in confronting relationship to these ports. Although in the embodiments described, the grooves have all been formed above the piston pin 19, it is to be understood that such grooves may also be formed below the piston pin or on both sides of the piston pin. In addition to the embodiments illustrated and described, various other changes and modifications may be made without departing from the spirit and scope of the invention, as defined by the appended claims.

We claim:

1. In a two-cycle internal combustion engine comprising a cylinder defining a cylinder bore, a crankcase at one end of said cylinder bore, a combustion chamber at the other end of said cylinder bore, a piston reciprocating in said cylinder bore and having a head portion facing said combustion chamber, a pair of circumferentially spaced ports extending through said cylinder for communication with said cylinder bore upon reciprocation of said piston in said cylinder bore at least one of said ports being formed at the end of a passage extending from said crankcase and comprising a scavenge port, the improvement comprising passage means formed in said piston for permitting flow between said scavenge port and another of said ports when said piston is in confronting relationship with said ports for effecting a cooling flow across said piston to dissipate heat therefrom.

2. In a two-cycle internal combustion engine as set forth in claim 1 wherein the piston is further provided with a piston ring and the passage means lies below the piston ring.

3. In a two-cycle internal combustion engine as set forth in claim 2 wherein the piston is provided with plural piston rings and the communicating passage means is below all of the piston rings.

4. In a two-cycle internal combustion engine as set forth in claim 1 wherein the piston is provided with a piston pin for connecting the piston to a crankshaft and wherein the passage means lies above the piston pin.

5. In a two-cycle internal combustion engine as set forth in claim 2 wherein the passage means comprises a circumferential groove formed in the outer periphery of the piston for effecting a blow-by seal in addition to a flow passage.

6. In a two-cycle internal combustion engine as set forth in claim 1 wherein the other port comprises at least one exhaust port.

7. In a two-cycle internal combustion engine as set forth in claim 6 further including further scavenge ports.

8. In a two-cycle internal combustion engine as set forth in claim 7 wherein the ports are circumferentially spaced relative to each other.

9. In a two-cycle internal combustion engine as set forth in claim 7 wherein only certain of the scavenge ports communicate with the exhaust port.

10. In a two-cycle internal combustion engine comprising a cylinder defining a cylinder bore, a piston reciprocating in said cylinder bore and having a head portion facing a combustion chamber, a pair of circumferentially spaced scavenge ports extending through said cylinder for communication with said cylinder bore upon reciprocation of said piston in said cylinder bore, the improvement comprising passage means formed in said piston for permitting flow between said scavenge ports when said piston is in confronting relationship with said ports for effecting a cooling flow across said piston to dissipate heat therefrom.

11. In a two-cycle internal combustion engine as set forth in claim 10 further including an exhaust port, said passage means being out of communication with said exhaust port.

12. In a two-cycle internal combustion engine as set forth in claim 11 wherein the passage means is formed in the periphery of the piston.

13. In a two-cycle internal combustion engine as set forth in claim 10 wherein the piston is further provided with a piston ring and the passage means lies below the piston ring.

14. In a two-cycle internal combustion engine as set forth in claim 13 wherein the piston is provided with plural piston rings and the communicating passage means is below all of the piston rings.

15. In a two-cycle internal combustion engine as set forth in claim 10 wherein the piston is provided with a piston pin for connecting the piston to a crankshaft and wherein the passage means lies above the piston pin.

16. In a two-cycle internal combustion engine as set forth in claim 15 wherein the passage means comprises a circumferential groove formed in the outer periphery of the piston for effecting a blow-by seal in addition to a flow passage.

17. In a two-cycle internal combustion engine as set forth in claim 10 wherein the passage means is formed in the periphery of the piston.

18. In a two-cycle internal combustion engine as set forth in claim 17 wherein the piston is further provided with a piston ring and the passage means lies below the piston ring.

19. In a two-cycle internal combustion engine as set forth in claim 18 wherein the piston is provided with plural piston rings and the communicating passage means is below all of the piston rings.

20. In a two-cycle internal combustion engine as set forth in claim 17 wherein the piston is provided with a piston pin for connecting the piston to a crankshaft and wherein the passage means lies above the piston pin.

* * * * *